United States Patent [19]

Yoan et al.

[11] Patent Number: 4,501,524

[45] Date of Patent: Feb. 26, 1985

[54] DRILL STRING ELEMENT HANDLING APPARATUS

[75] Inventors: Toyohiko Yoan, Osaka; Norishige Muto, Hirakata, both of Japan

[73] Assignee: Kabushiki Kaisha Komatsu Seisakusho, Tokyo, Japan

[21] Appl. No.: 425,944

[22] Filed: Sep. 28, 1982

[30] Foreign Application Priority Data

Jun. 14, 1982 [JP] Japan ..... 57-100690

[51] Int. Cl.[3] ..... E21B 19/14

[52] U.S. Cl. ..... 414/22; 175/52; 211/70.4

[58] Field of Search ..... 414/22, 745; 175/52, 175/85; 211/60 S

[56] References Cited

U.S. PATENT DOCUMENTS

| | | | |
|---|---|---|---|
| 3,336,991 | 8/1967 | Klem et al. | 414/22 X |
| 3,664,439 | 5/1972 | Council | 175/85 |
| 3,913,754 | 10/1975 | Swartz et al. | 414/22 |
| 3,985,189 | 10/1976 | Jahnke et al. | 414/22 X |
| 3,986,569 | 10/1976 | Hilding et al. | 175/52 |
| 4,049,065 | 9/1977 | Walter | 175/85 X |
| 4,050,590 | 9/1977 | Benjamin | 175/85 X |
| 4,258,796 | 3/1981 | Horning et al. | 175/52 |

*Primary Examiner*—Leslie J. Paperner

*Attorney, Agent, or Firm*—Armstrong, Nikaido, Marmelstein & Kubovcik

[57] ABSTRACT

An apparatus for the handling of drill string elements, such as rods or pipes in drill rigs. The apparatus comprises an elongated guide member, a drifter movably mounted on the guide member for reciprocable movement therealong, a plurality of drill string elements for making up a drill string, a ring member rotatably mounted on the guide member, and a magazine for storing the drill string elements. The magazine is fixedly secured to the ring member and has formed therein a plurality of support holes for the drill string elements. For exactly positioning each drill string element for connecting the same with the drill string, a plurality of stoppers are provided on the ring member. Each stopper is positioned diametrically opposite to the respective support holes relative to a rotary center of the ring member.

4 Claims, 11 Drawing Figures

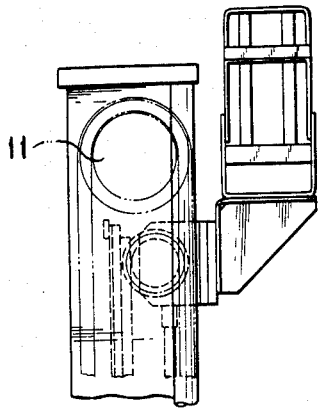
FIG. 2
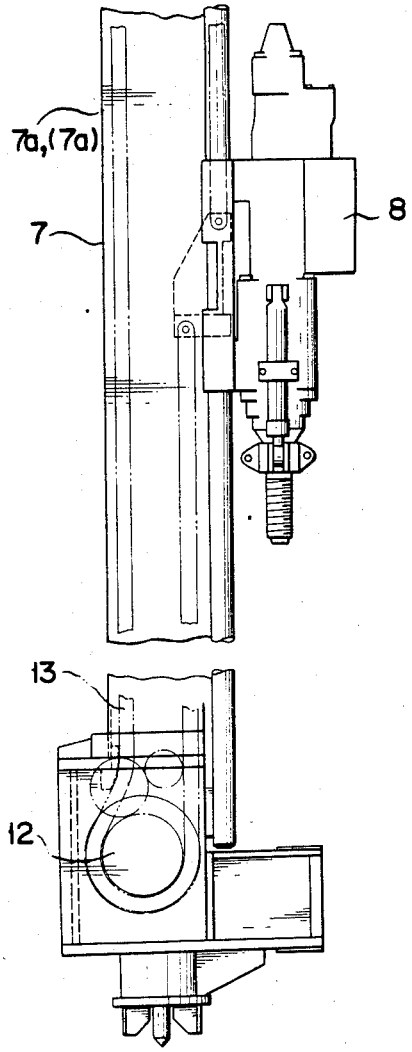
FIG. 3
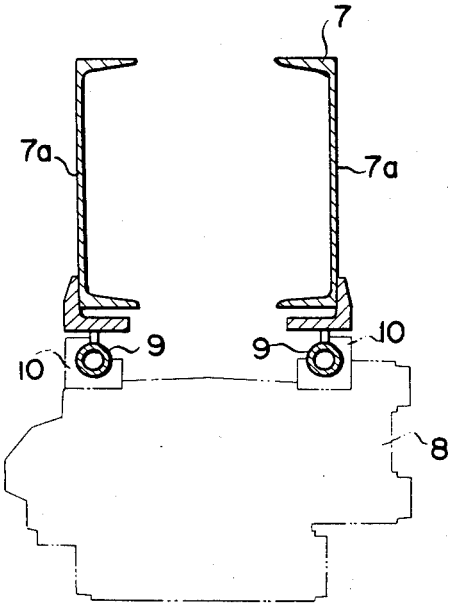

DRILL STRING ELEMENT HANDLING APPARATUS

BACKGROUND OF THE INVENTION

This invention relates to a drill string element handling apparatus of a drill machine mounted on a crawler vehicle. The drill string element as used herein includes a drill rod, drill pipe and the like and a series of connected drill string elements are called a drill string.

It has so far been necessary to extend successively drill rods or extension rods of the crawler-vehicle mounted drill as drilling operation proceeds. Therefore, in the vicinity of the guide member of a crawler-vehicle mounted drill there is installed a drill rod handling apparatus which supplies drill rods successively from its magazine to a drill string, and upon completion of the drilling operation the drill rods separated from the drill string are in turn accommodated in the magazine. Further, in the above-mentioned drill rod handling apparatus, there has heretofore been employed a method of supplying the drill rods previously accommodated in a magazine into the drill rod handling apparatus by means of a turning arm. However, this method has been disadvantageous in that because the construction of the magazine and the turning arm arragement is complicated and their weight is heavy and because the magazine projects outside the guide member considerably the guide member itself must be constructed in a large-sized and robust structure.

SUMMARY OF THE INVENTION

It is therefore an object of the present invention to provide a drill string elements handling apparatus which is compact in size yet can improve handling efficiency of the drill string elements.

Another object of the present invention is to provide a drill string elements handling apparatus mounted on a crawler vehicle in which drill string elements can be neatly stored around a guide member and are transferred to a connecting and disconnecting position by rotating the drill string elements around the guide member.

In accordance with an aspect of the present invention, there is provided an apparatus in a drill rig for moving drill string elements between a drill string element magazine and a drill string and for connecting and disconnecting said drill string elements to and from said drill string, comprising: an elongated guide member; a drifter movably mounted on said guide member for reciprocable movement therealong; a plurality of drill string elements for making up a drill string; a ring member rotatably mounted on said guide member; a magazine for storing said drill string elements, said magazine being fixedly secured to said ring member and having formed therein a plurality of support holes for said drill string elements; a plurality of stoppers each mounted to said ring member at a position diametrically opposite to said respective support holes relative to a rotary center of said ring member; and means for rotating said ring member around said guide member wherein each center of said support holes and a projection of a center of said drill string are on a common circle having its center coincided with the rotary center of said ring member.

A plurality of cylinder means are mounted on the magazine each facing to the respective support holes for supporting and holding the drill string elements, such as drill rods or pipes, within the support holes. A locking means including a cylinder is mounted on the guide member for engaging the stoppers and locking the magazine in a predetermined position thereby allowing connecting and disconnecting steps to be taken between the magazine and the drill string.

In a preferred embodiment, two sets of magazines are provided along the elongated guide member for supporting upper and lower ends portions of the drill string elements.

The above and other objects, features and advantages of the present invention will be readily apparent from the following description taken in conjunction with the accompanying drawings.

BRIEF DESCRIPTION OF THE DRAWINGS

FIG. 2 is a front elevational view of a guide member with a drifter movably mounted thereto;

FIG. 3 is a cross-sectional view of the guide member with the drifter shown in dash and dot line.

DESCRIPTION OF THE PREFERRED EMBODIMENT

Figure 1:
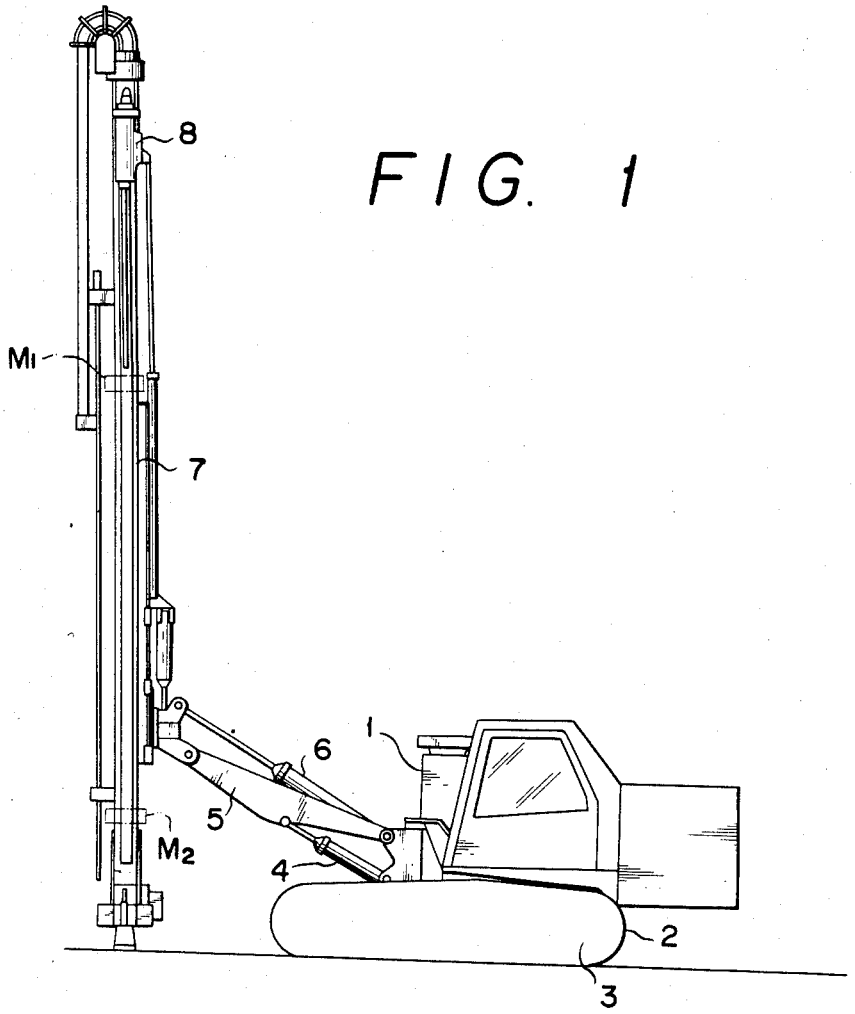
FIG. 1 is a perspective view of a crawler vehicle mounted drill employing a drill string elements handling apparatus of the present invention.

The present invention will now be described in detail below by way of example only with reference to the accompanying In the drawings, reference numeral 1 denotes a crawler vehicle body which is self-propelled by undercarriages 3 having endless tracks 2. The crawler vehicle is provided at its front part with a boom 5 which can be freely moved up and down by means of a boom cylinder 4. The boom 5 has a guide bar or member 7 pivotally mounted at its leading end and which can be freely moved up and down by means of a guide member cylinder 6.

A drifter or drilling device 8 is mounted on the guide member 7 in such a manner that it can slide freely in the longitudinal direction and first and second magazines $M_1$ and $M_2$ are mounted on either side of the longitudinal direction thereby constructing a drill rod handling apparatus.

Stated in brief, as shown in FIGS. 2 and 3, the guide member 7 is comprised of a pair of U-shaped frames *7a*, *7a* spaced apart and interconnected by a cross-member (not shown), the pair of frameworks *7a*, *7a* each having a guide rail 9 extending therealong. Each of the guide rails 9 carries a sliding member 10 fixedly secured to the bottom portion of the drifter 8. Connected to the drifter 8 at both ends, a roller chain 13 extends around sprockets 11 and 12 carried at the upper and lower ends of the guide member 7 so that the drifter 8 may be moved freely along the guide member 7 on the guide rails 9 with the movement of the roller chain 13.

The first magazine $M_1$ is constructed as follows. In brief, the pair of frames *7a, 7a* have a guide member 20 mounted thereon, said guide member 20 having mounted thereon a circular guide plate 21 which is concentric with the center or axis 7' of the guide member 7, the guide plate 21 having a ring member 22 rotatably carried thereby through bushings 23. The ring member 22 is held by a retainer flanges 25 to prevent the ring from getting out of the place.

Fixedly secured to the ring member 22 are a fan-shaped holder member 26 and a fan-shaped ring gear 70, which are spaced circumferentially from each other. The holder member 26 has first, second, third and fourth support holes $27_1$, $27_2$, $27_3$ and $27_4$ formed therein circumferentially at equal space intervals and which are located along a locus circle X having its center coincided with the center 7' of the guide member 7. The locus circle X has a radius which is equal to the distance between the center 7' of the guide member 7 and the center of a rod 8*a* of the drifter 8. The rod 8*a* is to be connected to a drill string. Further, the first to fourth support holes $27_1$ to $27_4$ are interconnected by a cutaway groove 28. In brief, each of the support holes $27_1$ to $27_4$ has a diameter which is slight larger than that of sleeve 52 of a drill rod 50, and the cutaway groove 28 is narrower than the sleeve 52 and wider than the rod part 51. Located opposite to the support holes $27_1$, $27_2$, $27_3$ and $27_4$ are first, second, third and fourth holding cylinders $29_1$, $29_2$, $29_3$ and $29_4$ which serve to hold drill rods $50_1$, $50_2$, $50_3$ and $50_4$ inserted in the support holes $27_1$, $27_2$, $27_3$ and $27_4$, respectively.

Figure 4:
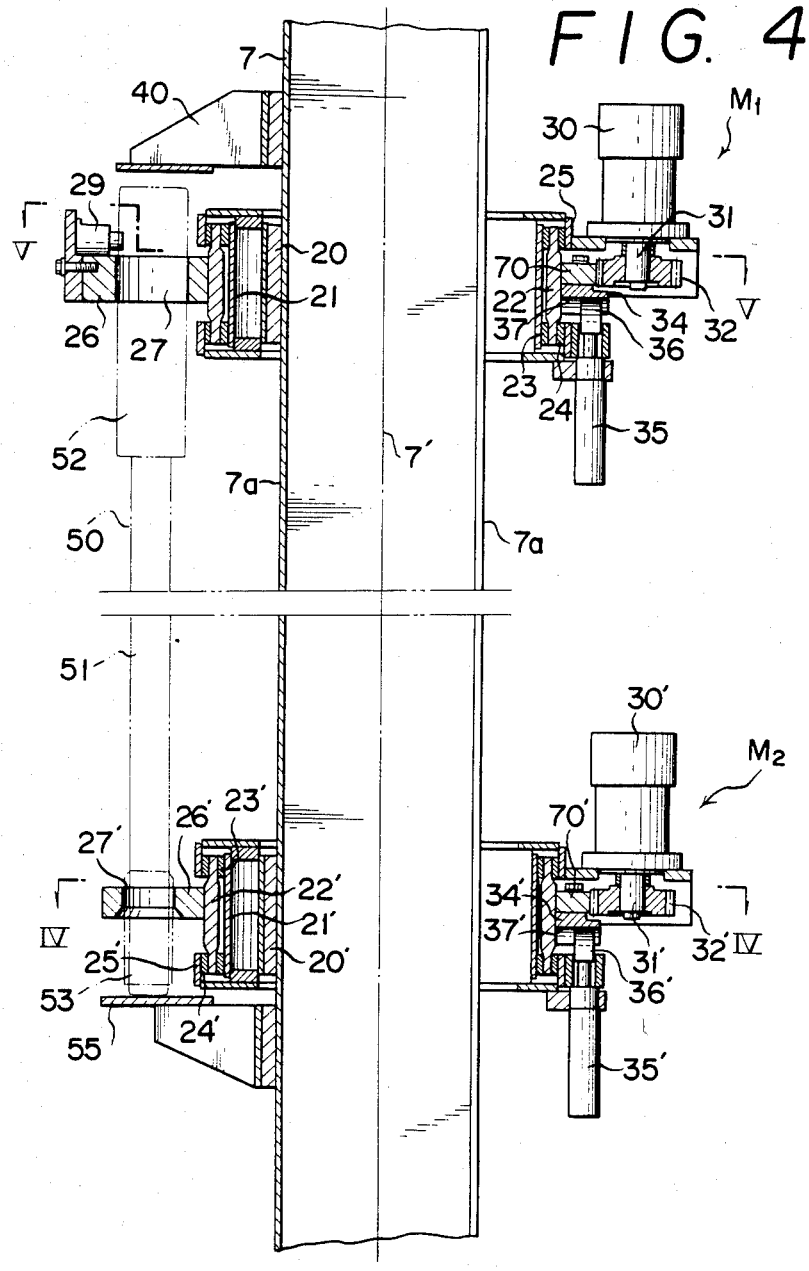
FIG. 4 is a longitudinal cross-sectional view of upper and lower magazines with right half being angularly displaced 90° from the original position.
Figure 5:
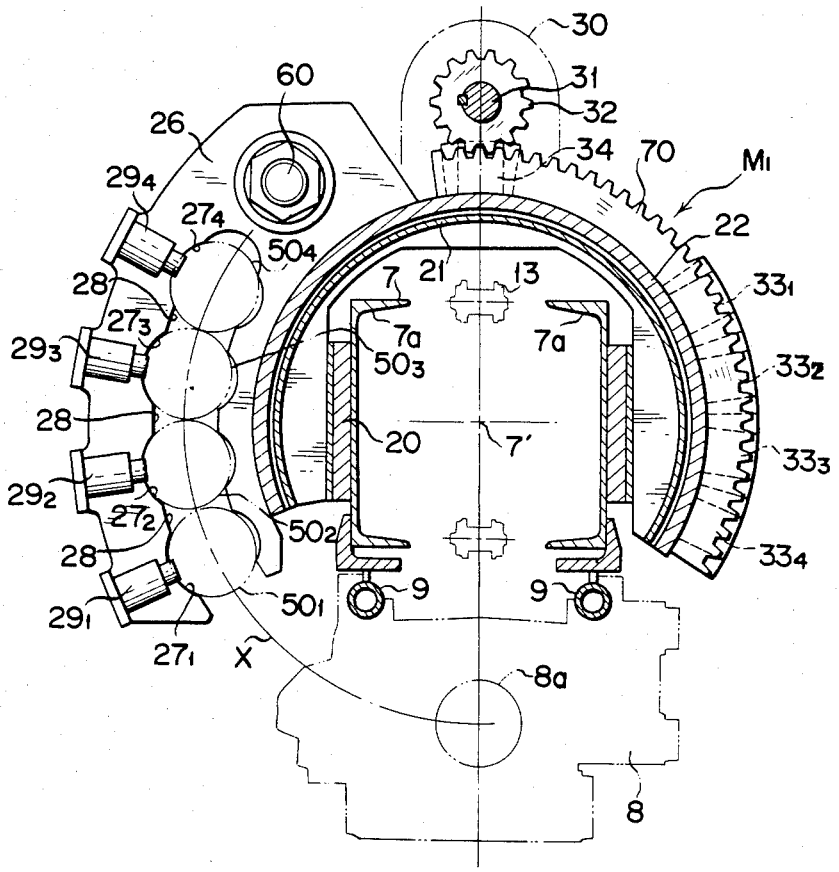
FIG. 5 is a cross-sectional view of the upper magazine taken along the line V—V of FIG. 4.
Figure 6:
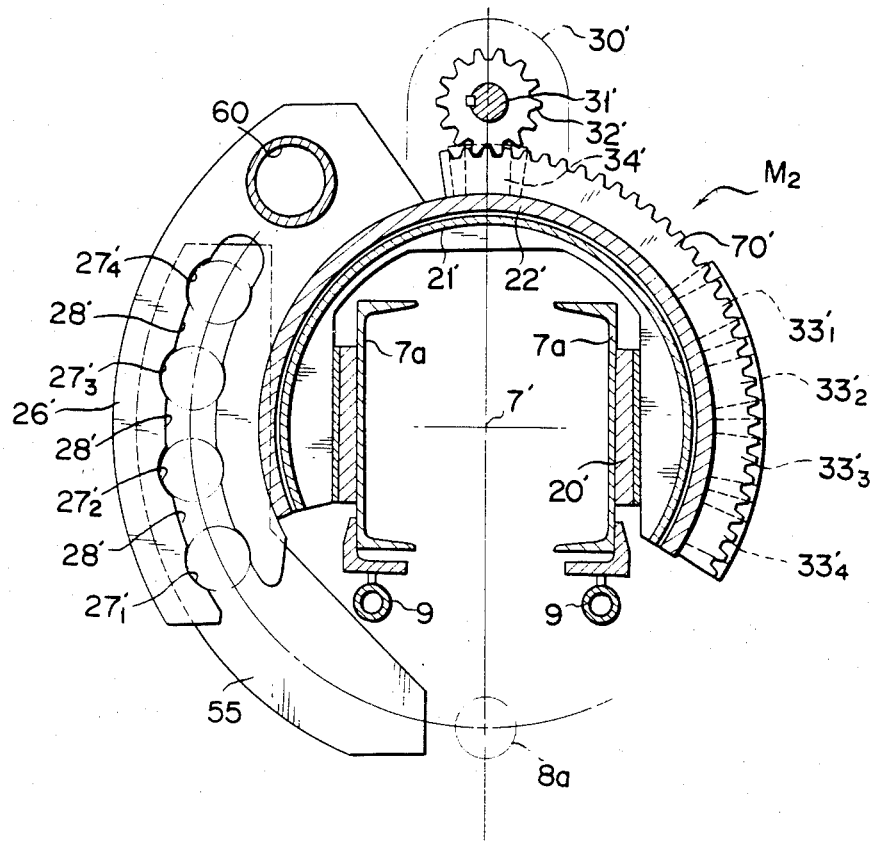
FIG. 6 is a cross-sectional view of the lower magazine taken along the line IV—VI of FIG. 4.
Figure 7:
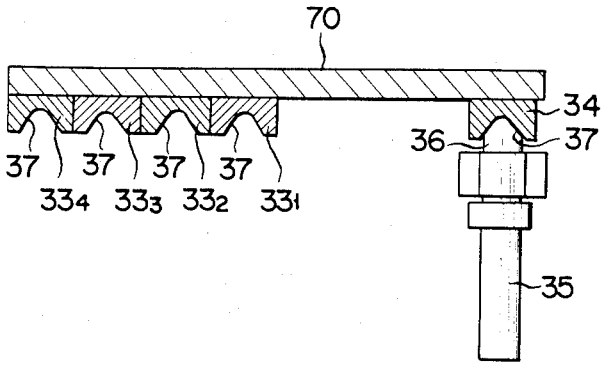
FIG. 7 is a developed sectional view of stoppers showing engagement of one of stoppers with a locking means.
Figure 8:
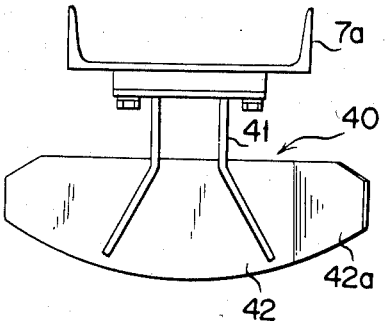
FIG. 8 is a plan view of a drill rod top end holding member.
Figure 9:
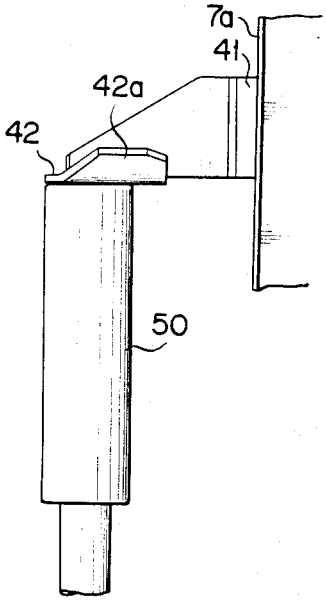
FIG. 9 is a side elevational view thereof.
Figure 10:
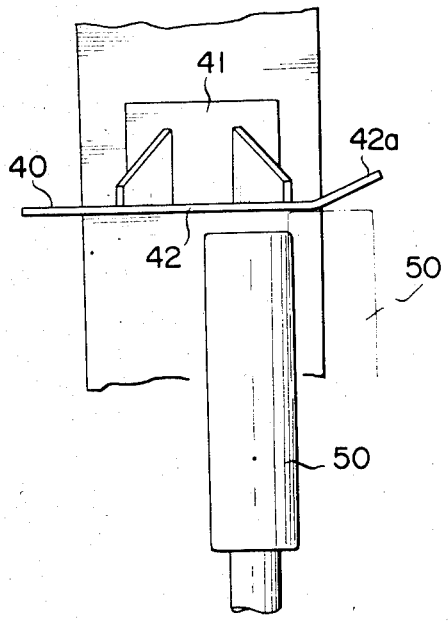
FIG. 10 is a front elevational view thereof.
Figure 11:
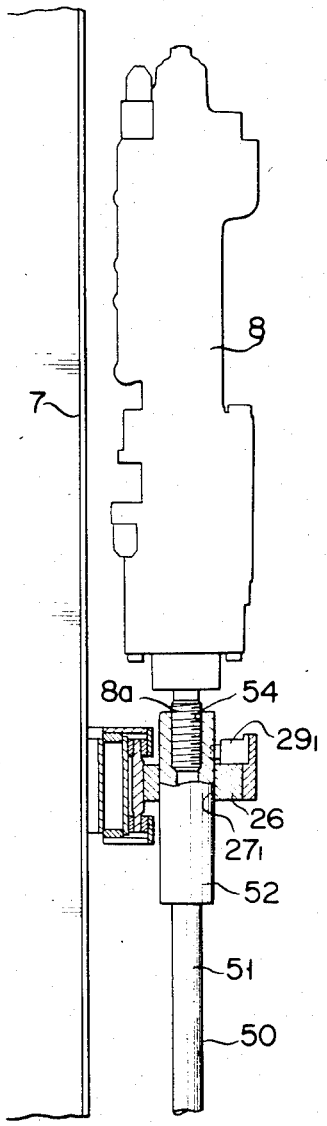
FIG. 11 is a side elevational view of a drifter with parts shown in section for clarity showing how a drill rod is connected with the drifter.

Fixedly secured to the guide member 20 is a motor 30 with a rotary shaft 31 having a pinion 32 fixedly secured thereto and engaging with the ring gear 70. The ring gear 70 has first, second, third and fourth stoppers $33_1$, $33_2$, $33_3$ and $33_4$ fixedly secured thereto at locations diametrically opposite to the aforementioned first, second, third and fourth support holes $27_1$, $27_2$, $27_3$ and $27_4$ relative to the center 7' of the guide member 7, and also an original position indexing stopper 34 fixedly secured thereto at a location diametrically opposite to the center of the drifter 8 relative to the center 7' of the guide member 7. The guide member 20 has a positioning cylinder 35 fixedly secured thereto opposite to the original position indexing stopper 34. The cylinder 35 enables a locking rod 36 to be freely engaged with and disengaged from locking grooves 37 of the stoppers $33_1$, $33_2$, $33_3$ and $33_4$ (Refer to FIGS. 4 and 7).

Reference numeral 40 denotes a retainer member which is fixedly secured to the guide member 7 and which serves to position the drill rod 50 longitudinally. In brief, the retainer member 40 comprises a bracket 41 having a plate 42 fixedly secured thereto, one end 42*a* of the plate 42 being bent as shown so that even when the drill rod 50 is displaced upwards a little bit from its normal position the bent portion 42*a* can effect correction of the position.

Further, since the second magazine $M_2$ has a construction similar to that of the first magazine $M_1$, the detailed description of it is omitted herein. However, the second magazine $M_2$ does not include the holding cylinder 29, and support holes 27' of holder member 26' have a size which allows a screw threaded portion 53 of the drill rod 50 to be inserted and supported therein.

Besides, a rod retainer member 55 is mounted to the guide member 7. The holder members 26 and 26' of the first and second magazines $M_1$ and $M_2$ are connected by means of a connecting rod 60.

Now, the operation of the drill rod handling apparatus of the present invention will be described below.

The drifter 8 is moved upwards so that its rod 8*a* is located above the first magazine $M_1$.

Under such a condition, the locking rods 36 and 36' are drawn out of the locking grooves 37 and 37' of the original position indexing stoppers 34 and 34' by means of the positioning cylinders 35 and 35', and the motors 30 and 30' are driven to rotate the ring members 22 and 22' counter-clockwise through the pinions 32 and 32' and the ring gears 70 and 70'. As a result, the holder members 26 and 26' are rotated and moved so that the first drill rod 50 may be located opposite to the rod 8*a* and aligned therewith.

Then the locking rods 36 and 36' are engaged with the locking grooves 37 and 37' of the first stoppers $33_1$ and $33_1'$ by means of the positioning cylinders 35 and 35' so as to align the axis of the first drill rod 50 and the rod 8*a*.

After that, the drifter 8 is moved down and the screw threaded portion of the rod 8*a* is threadably engaged with the threaded hole 54 of the sleeve 52 of the first drill rod 50, and then the first holding cylinder $29_1$ is retracted to release the first drill rod 50. Then, the drifter 8 is moved upwards so that the sleeve 52 of the first drill rod 50 may be drawn out upwardly from the first support hole $27_1$ to thereby locate the rod part 51 into the first support hole $27_1$.

Under such a condition, the ring members 22 and 22' are turned in clockwise direction, so as to rotate the holder members 26 and 26' in clockwise direction with the result that the holder members 26 and 26' are returned to their original positions leaving the first drill rod 50 as it is.

Thereafter, the locking rods 36 and 36' are engaged with the locking grooves 37 and 37' of the original position indexing stoppers 34 and 34' by means of the positioning cylinders 35 and 35' to thereby fixedly secure the holder members 26 and 26' at their predetermined accommodating positions.

Then, the drifter 8 is moved down to enable the first drill rod 50 to be threadably engaged and connected with the screw-threaded hole 54 of the sleeve of the preceding drill rod.

Thus, the drill rods can be connected readily in turn only by operating the positioning cylinders 35, 35', the motors 30 and 30' and the holding cylinder 29.

As described hereinabove, according to the present invention, the magazines holding the drill rods do not project largely out of the guide member and the device itself is simple and small in size thereby reducing the size and weight of the guide member itself.

Further, the centers of the support holes 27 and 27' can be aligned accurately with the drill string by means of the positioning stoppers 33, 33' and the positioning members 36 and 36', and therefore it becomes possible to effect handling of drill rods in a short time thereby enabling the operational efficiency to be improved considerably.

What is claimed is:

1. An apparatus in a drill rig for moving drill string elements between a drill string element magazine and a drill string and for connecting and disconnecting said drill string elements to and from said drill string, comprising:

an elongated guide member;

a drifter movably mounted on said guide member for reciprocable movement therealong;

a plurality of drill string elements for making up a drill string;

a ring member rotatably mounted on said guide member;

a magazine for storing said drill string elements, said magazine being fixedly secured to said ring member and having formed therein a plurality of support holes for said drill string elements;

a plurality of stoppers each mounted to said ring member at a position diametrically opposite to said respective support holes relative to a rotary center of said ring member;

means for rotating said ring member around said guide member wherein the centers of each of said support holes and a projection of a center of said drill string are on a common circle having its center coinciding with the rotary center of said ring member; and a plurality of first cylinder means each mounted on said magazine opposite to said respective support holes for supporting said drill string elements within said support holes, and locking means including a second cylinder for engaging said stoppers and locking said magazine at a predetermined position.

2. An apparatus according to claim 1 wherein said rotating means comprises a motor mounted on said guide member, a pinion gear connected to said motor and a ring gear fixedly secured to said ring member and adapted to mesh with said pinion gear.

3. An apparatus according to claim 1 further comprising an additional stopper mounted to said ring member at a position diametrically opposite to said drill string relative to the rotary center of said ring member.

4. An apparatus according to claim 1 further comprising:

a second ring member rotatably mounted on said guide member longitudinally spaced from said first recited ring member;

a second magazine for storing said drill string elements, said second magazine being fixedly secured to said second ring member and having formed therein a plurality of second support holes for said drill string elements;

a plurality of second stoppers each mounted to said second ring member at a position diametrically opposite to said respective second support holes relative to a rotary center of said second ring member;

means for rotating said second ring member around said guide member; and means for connecting said second magazine with said first recited magazine.

* * * * *